US006621204B2

(12) United States Patent
Kakesu et al.

(10) Patent No.: US 6,621,204 B2
(45) Date of Patent: Sep. 16, 2003

(54) COLOR CATHODE RAY TUBE HAVING A DEFLECTION UNIT

(75) Inventors: Takateru Kakesu, Isumi (JP); Nobuyuki Koganezawa, Chiba (JP); Kouichi Honma, Chiba (JP)

(73) Assignees: Hitachi, Ltd., Tokyo (JP); Hitachi Engineering Co., Ltd., Tokyo (JP)

( * ) Notice: Subject to any disclaimer, the term of this patent is extended or adjusted under 35 U.S.C. 154(b) by 5 days.

(21) Appl. No.: 10/081,284

(22) Filed: Feb. 22, 2002

(65) Prior Publication Data

US 2002/0145376 A1 Oct. 10, 2002

(30) Foreign Application Priority Data

Mar. 9, 2001 (JP) ..... 2001-066055

(51) Int. Cl.[7] ..... H01J 29/46

(52) U.S. Cl. ..... 313/442; 313/269; 313/440

(58) Field of Search ..... 313/440, 441, 313/442, 269; 335/210, 212

(56) References Cited

U.S. PATENT DOCUMENTS 4,673,906 A * 6/1987 Petrow ..... 335/210
5,783,902 A * 7/1998 McCann ..... 313/440

* cited by examiner

*Primary Examiner*—Sandra O'Shea
*Assistant Examiner*—Sumati Krishnan
(74) *Attorney, Agent, or Firm*—Milbank, Tweed, Hadley & McCloy LLP

(57) ABSTRACT

A clamp unit which brings respective vertical and horizontal cores and bias magnets of a magnetic current modulator into close contact with each other in the core arrangement direction is provided to a resin casing of the magnetic current modulator. Due to such a constitution, the generation of an uncomfortable sound derived from a magnetic distortion of cores of the magnetic current modulator incorporated in a deflection unit can be prevented.

8 Claims, 8 Drawing Sheets

COLOR CATHODE RAY TUBE HAVING A DEFLECTION UNIT

BACKGROUND OF THE INVENTION

1. Field of the Invention

The present invention relates to a color cathode ray tube which displays a color image, and more particularly to a color cathode ray tube having a deflection unit of an improved structure.

2. Description of the Related Art

A color cathode ray tube which is used as a color television picture tube, a monitor tube of an information equipment or the like is constituted of a vacuum envelope which is formed by connecting a panel portion having a phosphor screen (also simply referred to as "screen") on an inner surface thereof and a neck portion which accommodates an electron gun for irradiating electron beams by means of a funnel portion.

In the color cathode ray tube having such a vacuum envelope, to obtain the best convergence under the favorable focusing characteristic over the whole region of a phosphor screen which constitutes a display screen thereby obtaining the high resolution without color irregularities, a magnet assembly which is constituted of magnets having a plurality of magnetic poles is arranged on an outer surface of the neck portion which accommodates the electron gun and the loci of electric beams are corrected by the magnetic field.

Further, the color cathode ray tube includes horizontal and vertical deflection coils for performing the deflection scanning of electron beams irradiated from the electron gun in the horizontal direction as well as in the vertical direction. Further, the color cathode ray tube exteriorly mounts a deflection unit which includes a rotation correction coil which corrects the rotation of an image (raster) on the screen and a magnetic current modulator (MCM) which corrects raster distortions, that is, a so-called inner pin at a central region of the screen on a boundary between the neck portion and the funnel portion.

FIG. 8 is a side cross-sectional view for schematically explaining a structural example of a color cathode ray tube which mounts a deflection unit on a color cathode ray tube. The color cathode ray tube is formed of a vacuum envelope which is constituted of a panel portion 1 having a phosphor screen 4, a neck portion 2 and a funnel portion (also referred to as "cone portion") 3 which contiguously connects the panel portion 1 and the neck portion 2. The color cathode ray tube is also configured such that a deflection unit 15 which includes a deflection yoke 16 is exteriorly mounted over a transitional region from the neck portion 2 to the funnel portion 3.

An electron gun 11 which irradiates three electron beams B are housed in the inside of the neck portion 2, the phosphor screen 4 which is formed on an inner surface of the panel portion 1 includes three-colored phosphors coated thereon in a mosaic form, and a shadow mask structural body 5 which constitutes a color selection electrode is arranged in the vicinity of the phosphor screen 4.

The shadow mask structural body 5 includes a support frame 7 which holds a shadow mask 6 and is held by engaging suspension springs 8 with stud pins 9 which are mounted in an erected manner on an inner wall of a skirt portion of the panel portion 1. Further, a magnetic shield 10 which shields an external magnetic field is mounted on an electron-gun side of the shadow mask structural body 5

Here, an implosion prevention band 14 is fastened to an outer-side wall of the panel portion 1.

FIG. 9 is enlarged side view of the deflection unit 15 which is exteriorly mounted on the color cathode ray tube. An arrow P side of the deflection yoke 16 incorporated into the deflection unit 15 is a large-diameter portion which constitutes a phosphor screen side and an arrow G side is a small-diameter portion which constitutes an electron-gun side and exhibits an approximately funnel shape. A horizontal deflection coil is disposed in the inside of the deflection yoke 16 and the vertical deflection coil is disposed in the outside of the deflection yoke 16 by way of a separator. Further, a core made of ferrite or the like is disposed in the outside of the vertical deflection coil.

Further, a rotation correction coil 17 is mounted on the large-diameter-portion-side end portion of the deflection yoke 16, while a magnet assembly 12 which is formed by combining magnets of 4 poles or 6 poles is mounted on the small-diameter-portion side of the deflection yoke 16.

An upper protective cover 19 which houses a convergence adjusting circuit board 18 is provided to a top portion (upper side in FIG. 9) of the deflection unit 16, while a lower protective cover 21 which houses a circuit board on which a magnetic current modulator (MCM) 20 is mounted is provided to a bottom portion (lower side in FIG. 9) of the deflection unit Further, a fixing band 22 is provided to the small-diameter-portion side of the deflection yoke 16 which constitutes the electron-gun side and the fixing band 22 is fixedly secured to the neck portion 2 by fastening. The whole deflection unit 15 is tilted using the fixing point as a fulcrum to adjust the deflection unit 15 to the best position and, thereafter, the deflection unit 16 is mounted on a portion ranging from the funnel portion 3 to the neck portion 2 by inserting a plurality of wedges between the large-diameter-portion side and the funnel portion 3.

Here, in FIG. 9, numeral 23 indicates a power supply line for supplying electricity to the rotation correction coil 17 and numeral 24 indicates a power supply line for supplying electricity to deflection coils.

FIG. 10 is a plan view for explaining a constitutional example of the magnetic current modulator 20. The magnetic current modulator 20 is served for correcting the pin distortions at a central region of a screen of the cathode ray tube and is constituted of modulation coils which are respectively inserted into a vertical deflection coil and a horizontal deflection coil in series and a bias magnet.

In FIG. 10, numeral 202 indicates a vertical modulation coil and numerals 203 and 204 indicate horizontal modulation coils. A structure in which the horizontal modulation coils 203 and 204 are arranged at both sides of the vertical modulation coil 202 and these modulation coils 203, 204 are sandwiched by bias magnets 205, 206 from both sides is housed in the inside of a resin casing 201 and is mounted on a printed circuit board which will be explained later. Here, respective coils are wound around magnetic cores and an adhesive agent 208 is coated over each portion defined between cores of the neighboring coils and bias magnets 205, 206 which are arranged close to the cores so as to fix them together.

FIG. 11 is a developed view for explaining the arrangement of the coils and bias magnets of the magnetic current modulator. The vertical modulation coil 202 is constituted of a vertical modulation coil 202*b* which is wound around one vertical core 202*a* and the horizontal modulation coils 203, 204 are constituted of horizontal modulation coils 203*b*,

203*d*, 204*b*, 204*d* which are respectively wound around respective pairs of horizontal cores 203*a*, 203*c*, 204*a*, 204*c* which are arranged in parallel.

At both ends in the winding axis direction of the vertical modulation coil 202, the winding axis directions of the horizontal modulation coils 203, 204 are arranged in parallel and the bias magnets 205, 206 are arranged at the outermost side of the horizontal modulation coils 203, 204.

The winding axis directions of the vertical modulation coil 202 and respective horizontal modulation coils 203, 204 are set to directions which generate magnetic fields indicated by arrows in the drawing and these modulation coils are inserted between the vertical deflection coil and the horizontal deflection coil in series so as to correct the inner pin distortions of the raster on the screen.

FIG. 12 is a plan view for explaining a mounting state of the magnetic current modulator 20 on a printed circuit board 207. The magnetic current modulator 20 is mounted on the printed circuit board 207 in place. The printed circuit board 207 and the magnetic current modulator 20 are fixedly secured to each other using an adhesive agent 209. Here, the resin casing 201 of the magnetic current modulator 20 and the printed circuit board 207 may be fixedly secured to each other using stopper means or other known fixing means such as caulking or screwing together with the adhesive agent 209.

As a literature which discloses a related art relevant to this type of cathode ray tube, Japanese Laid-open Patent Publication 268746/2000 can be named, for example.

In the cathode ray tube using the magnetic current modulator having such a constitution, during the operation, the vertical or horizontal cores 202*a*, 203*a*, 203*c*, 204*a*, 204*c* or the bias magnets 205, 206 which constitute the magnetic current modulator 20 generate the magnetic distortion due to the magnetic fields generated by respective coils. Accordingly, there have been cases in which the mechanical vibrations caused by these magnetic distortions impinge on the neighboring vertical and horizontal cores, bias magnets or the resin casing so that an uncomfortable sound, so-called "singing" is generated.

This uncomfortable sound constitutes a "beating sound" having high frequency of a specified horizontal frequency which flows in the deflection yoke, for example, approximately 15 kHz in the vicinity of 69 kHz,. There is a possibility that such an uncomfortable sound is generated at a band of other frequencies in the similar manner. Such an uncomfortable sound brings about the poor evaluation of the quality of a monitor or a picture receiving set which incorporates the cathode ray tube therein.

SUMMARY OF THE INVENTION

The present invention provides a cathode ray tube of high quality by preventing the occurrence of an uncomfortable sound derived from a magnetic current modulator in the cathode ray tube.

According to the present invention, a clamp unit which brings respective vertical and horizontal cores and the bias magnets of a magnetic current modulator into close contact with each other in the arrangement direction (axial direction) of the respective cores is disposed in a resin casing of the magnetic current modulator.

The clamp unit uses a resilient body which is made of non-magnetic material such as stainless steel and is preferably formed of non-magnetic metal, wherein the above-mentioned respective cores and bias magnets are brought into pressure contact with each other from the outside of the resin casing by means of a resilient body in the axial direction of the vertical and horizontal cores.

Due to such a constitution, the generation of an uncomfortable sound derived from the magnetic distortion of the vertical and horizontal cores or the bias magnets which constitute the magnetic current modulator can be prevented so that the quality of a monitor or a picture receiving set which incorporates a cathode ray tube therein can be enhanced.

Further, by coating an adhesive agent on a portion between the neighboring respective vertical and horizontal cores and a portion between these cores and the bias magnets disposed close to the vertical and horizontal cores, the generation of the uncomfortable sound can be prevented more effectively.

DESCRIPTION OF THE PREFERRED EMBODIMENTS

Figure 1:
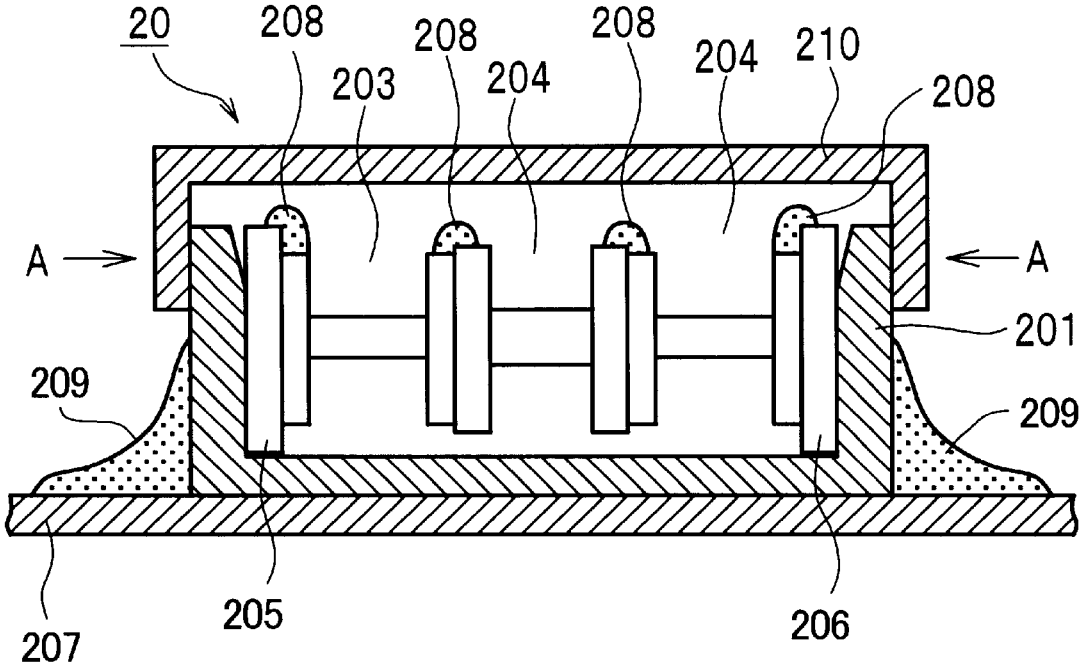
FIG. 1 is a schematic cross-sectional view for explaining the constitution of the first embodiment of a magnetic current modulator used in a color cathode ray tube according to the present invention.

To enumerate typical constitutions of the present invention, they are as follows.

(1) In a color cathode ray tube, a vacuum envelope is constituted of a panel portion having a phosphor screen which forms a screen, a neck portion which houses an inline-type electron gun irradiating electron beams, and a funnel portion which connects the panel portion and the neck portion contiguously, a deflection unit which comprises a deflection yoke which deflects the electron beams in two directions consisting of horizontal and vertical directions, a magnet assembly which optimizes color purity and convergence on a display screen on a phosphor screen by correcting loci of the electron beams, and a magnetic current modulator which corrects an inner pin distortion at a central portion of the screen are exteriorly mounted over the funnel portion and the neck portion, the magnetic current modulator includes a vertical core around which a vertical modulation coil which is inserted into a vertical deflection coil in series is wound, a pair of horizontal cores around which horizontal modulation coils which are disposed at both ends of the vertical core in the winding axis direction and inserted in series into a horizontal deflection coil are wound, a pair of bias magnets which are closely arranged in the winding axis direction of the respective horizontal cores and the respective vertical cores from the outside of a pair of respective horizontal cores, and a resin casing which houses the vertical cores, the horizontal cores and the bias magnets, and the color cathode ray tube further includes a clamp unit which resiliently presses the respective horizontal cores and vertical cores from the outside of the resin casing from both ends in the winding axis direction.

Due to such a constitution, the mechanical movement of the respective vertical and horizontal cores and the bias magnets of the magnetic current modulator can be suppressed by the resin casing which is resiliently pressed by the clamp unit so that the generation of an uncomfortable sound can be prevented.

(2) The clamp unit in the above-mentioned (1) is formed of non-magnetic metal.

Due to such a constitution, the clamping unit does not form a magnetic path and hence, the undesired influence which the magnetic field gives on the operation of above-mentioned magnetic current modulator can be prevented.

(3) Respective pairs of horizontal cores and the vertical core in the above-mentioned (1) or (2) are fixed to each other using an adhesive agent, and a pair of horizontal cores and a pair of the bias magnets in the above-mentioned (1) or (2) are fixed to each other by means of an adhesive agent.

Due to such a constitution, the mechanical movement between respective pairs of horizontal cores and the vertical core of the magnetic current modulator and the mechanical movement between a pair of horizontal cores and a pair of the bias magnets of the magnetic current modulator can be suppressed so that an uncomfortable sound can be surely prevented.

(4) The resin casing of the magnetic current modulator in the above-mentioned (1) to (3) is allowed to pass through an opening formed in the printed circuit board and, at the same time, the resin casing and the printed circuit board are fixedly secured to each other by an adhesive agent.

Due to such a constitution, the mechanical movement of the respective vertical and horizontal cores and the bias magnets of the magnetic current modulator is further suppressed by the resin casing which is resiliently pressed by the clamp unit and is also suppressed by the opening formed in the printed circuit board which allows the resin casing to pass through the opening whereby the generation of an uncomfortable sound can be prevented.

Either one of nonmagnetic non-metal and nonmagnetic metal can be used as the clamp unit. Further, the present invention is not limited to the above-mentioned constitution and the constitution of embodiments which will be described later and various modifications can be made without departing from the technical concept of the present invention.

Hereinafter, the mode for carrying out the present invention is explained in detail in conjunction with drawings which show the embodiments.

Figure 12:
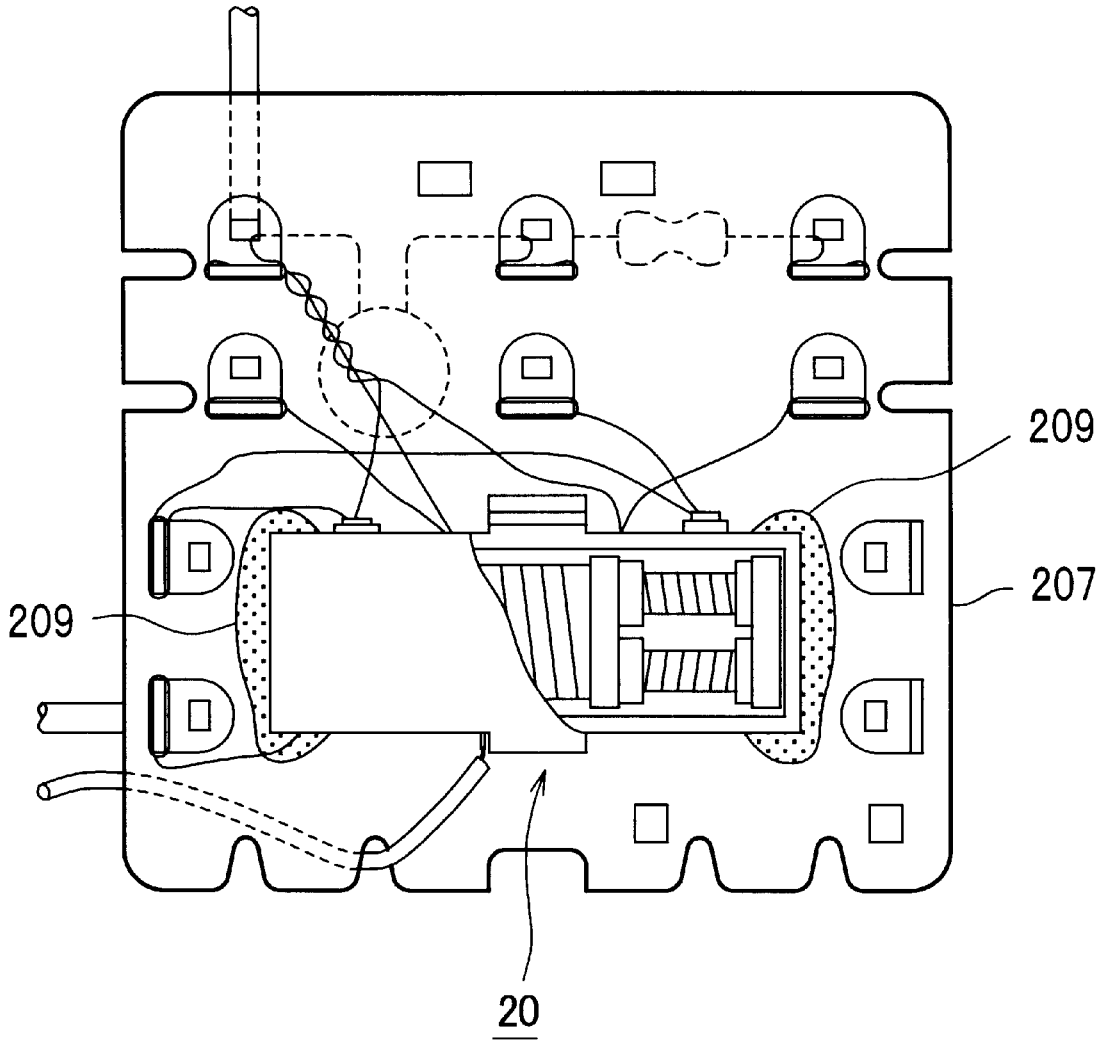
FIG. 12 is a plan view for explaining a mounting state of the magnetic current modulator to a printed circuit board.

FIG. 1 is a schematic cross-sectional view for explaining the constitution of the first embodiment of a magnetic current modulator used in a color cathode ray tube according to the present invention. This magnetic current modulator substantially has the same planar shape as the planar shape of the magnetic current modulator shown in FIG. 12. Here, in FIG. 1, coils which are wound around respective cores are omitted from the drawing.

In FIG. 1, the magnetic current modulator includes a vertical modulation coil 202, respective pairs of horizontal modulation coils 203, 204 which are arranged to be in close contact with the vertical modulation-coil 202 in the winding axis direction of the vertical modulation coil 202, and a pair of bias magnets 205, 206 which are arranged to be in close contact with respective outsides of respective pairs of horizontal modulation coils 203, 204.

Then, these respective coils and bias magnets are housed in a resin casing 201, are mounted on a printed circuit board 207 and thereafter are incorporated into a deflection unit. Here, the resin casing 201 and the printed circuit board 207 of the magnetic current modulator 20 can be fixedly secured to each other using stopper means or other known fixing means such as caulking and screwing together with an adhesive agent.

A clamp unit 210 which is made of stainless steel and has resiliency sandwiches and resiliently presses an opening portion of the resin casing 201.

Accordingly, the vertical modulation coil 202, respective pairs of horizontal modulation coils 203, 204 which are arranged to be in close contact with the vertical modulation coil 202 in the winding axis direction of the vertical modulation coil 202 and a pair of bias magnets 205, 206 which are arranged to be in close contact with respective outsides of respective pairs of horizontal modulation coils 203, 204 are maintained in a close-contact state due to the resilient pressing force generated by the clamp unit 210, whereby the mutual impingement caused by the magnetic distortion of respective cores during the operation can be suppressed thus preventing the occurrence of an uncomfortable sound.

Further, by fixedly securing the vertical modulation coil 202, respective pairs of horizontal modulation coils 203, 204 which are arranged to be in close contact with the vertical modulation coil 202 in the winding axis direction of the vertical modulation coil 202 and a pair of bias magnets 205, 206 which are arranged to be in close contact with respective outsides of respective pairs of horizontal modulation coils 203, 204 by coating an adhesive agent 208 to respective neighboring contact portions thereof, the close-contact state of these coils and magnets can be further enhanced.

Figure 2A:
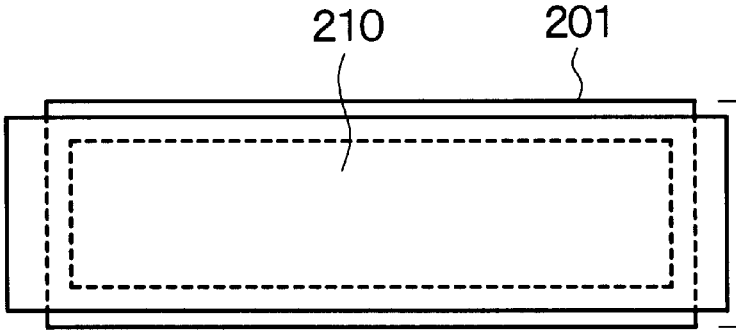
FIG. 2 is a schematic plan view for explaining the first embodiment of the magnetic current modulator used in the color cathode ray tube according to the present invention.
Figure 2B:
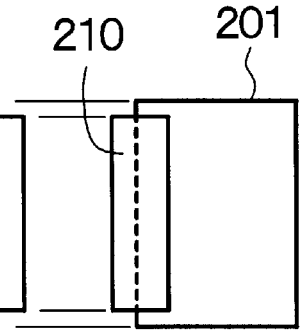

FIG. 2 is a schematic plan view for explaining the first embodiment of the magnetic current modulator used in the color cathode ray tube of the present invention. In this embodiment, a clamp unit 210 which resiliently presses a resin casing 201 has approximately the same planar shape as that of the resin casing 201.

In this embodiment, since the whole short sides of the resin casing 201 are resiliently pressed, it is possible to apply the uniform pressing force or pressure to the respective cores and the bias magnets housed in the inside of the resin casing 201.

Figure 3A:
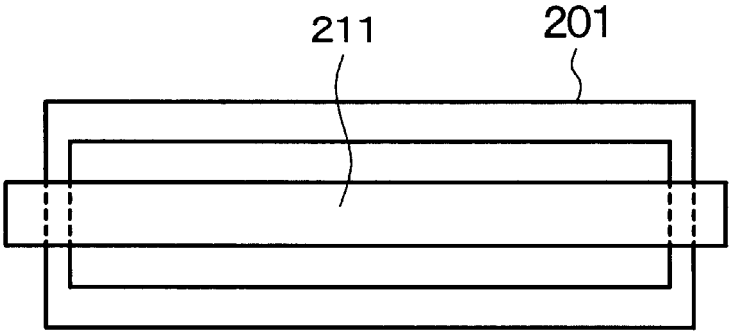
FIG. 3 is a schematic plan view for explaining the second embodiment of the magnetic current modulator used in the color cathode ray tube according to the present invention.
Figure 3B:
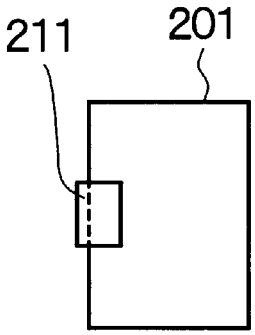

FIG. 3 is a schematic plan view showing the second embodiment of the magnetic current modulator used in the color cathode ray tube of the present invention. In this embodiment, a clamp unit 211 which resiliently presses a resin casing 201 is formed in a strip shape which is elongated in the longitudinal direction of the resin casing 201.

Also in this embodiment, a vertical modulation coil 202, respective pairs of horizontal modulation coils 203, 204 which are arranged to be in close contact with the vertical modulation coil 202 in the winding axis direction of the vertical modulation coil 202 and a pair of bias magnets 205, 206 which are arranged to be in close contact with respective outsides of respective pairs of horizontal modulation coils 203, 204 are maintained in a close-contact state due to the resilient pressing force generated by the clamp unit 211, whereby the mutual impingement caused by the magnetic distortion of respective cores during the operation can be suppressed thus preventing the occurrence of an uncomfortable sound.

Figure 4A:
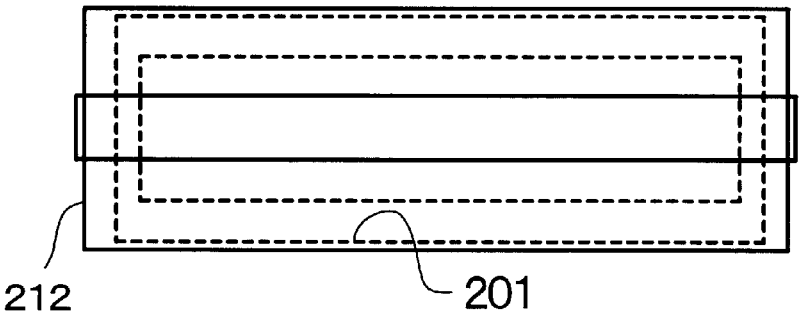
FIG. 4 is a schematic plan view for explaining the third embodiment of the magnetic current modulator used in the color cathode ray tube according to the present invention.
Figure 4B:
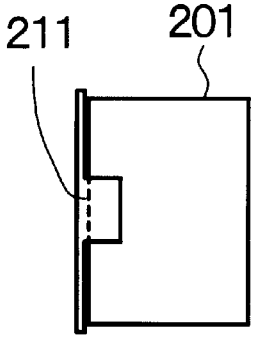

FIG. 4 is a schematic plan view for explaining the third embodiment of the magnetic current modulator used in the color cathode ray tube of the present invention. In this embodiment, a clamp unit 212 which resiliently presses a resin casing 201 has a shape which completely covers a planar shape of the resin casing 201 and, at the same time, a projection band having an elongated strip shape is formed on a central portion of the clamp unit 212 along the longitudinal direction of the resin casing 201.

In this embodiment, since the clamp unit 212 completely shields the magnetic current modulator from an external environment, it is possible to obtain a sound-proof effect that even when a small uncomfortable sound is generated, it is possible to shield the sound.

Figure 5:
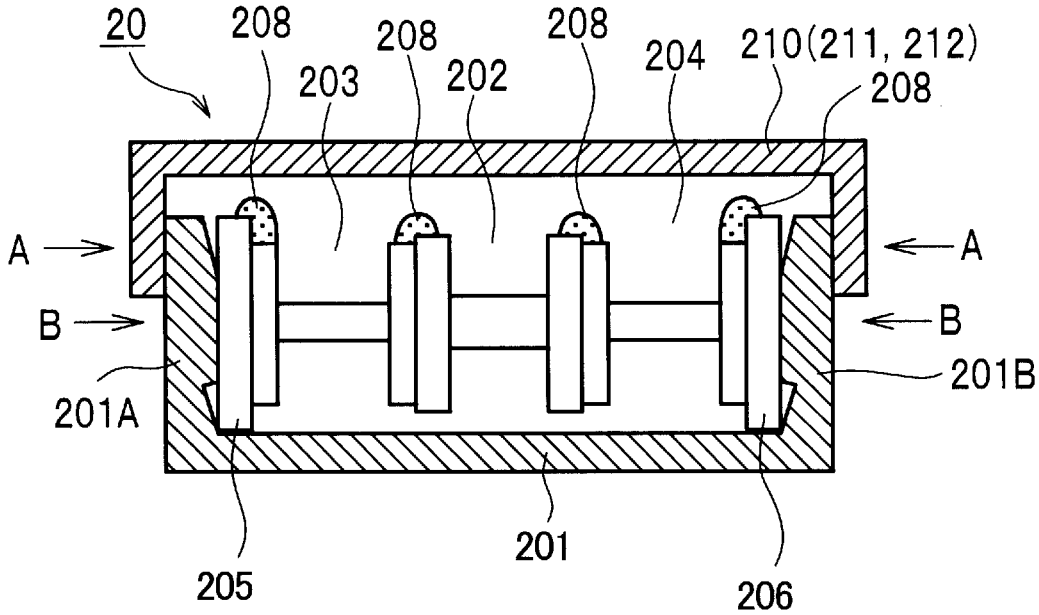
FIG. 5 is a schematic cross-sectional view for explaining the constitution of the fourth embodiment of the magnetic current modulator used in the color cathode ray tube according to the present invention.

FIG. 5 is a schematic cross-sectional view for explaining the constitution of the fourth embodiment of the magnetic current modulator used in the color cathode ray tube of the present invention. A planar shape of the magnetic current modulator is approximately as same as the planar shape of the magnetic current modulator shown in FIG. 12. Also in FIG. 5, coils which are wound around respective cores are omitted from the drawing. Numerals which are as same as the numerals used in FIG. 1 indicate parts having same functions.

In FIG. 5, a resin casing 201 which constitutes the magnetic current modulator has inner walls with which respective bias magnets 205, 206 are brought into contact and projections 201A, 201B are formed on such inner walls and at the time of housing respective cores and the bias magnets 205, 206 of the magnetic current modulator into the resin casing 201, the bias magnets 205, 206 are inserted against the projections 201A, 201B. Accordingly, a vertical modulation coil 202, a pair of horizontal modulation coils 203, 204 which are arranged to be in close contact with the vertical modulation coil 202 in the winding axis direction of the vertical modulation coil 202 and a pair of bias magnets 205, 206 which are arranged to be in close contact with respective outsides a pair of horizontal modulation coils 203, 204 are brought into close contact with each other whereby a further-improved sound-proof effect can be obtained.

Then, the deflection current modulator is mounted on a printed circuit board and is incorporated into a deflection unit. Here, the resin casing 201 and the printed circuit board of the magnetic current modulator 20 can be fixedly secured using stopper means or other known fixing means such as caulking or screwing together with an adhesive agent.

Also in this embodiment, by fixedly securing the vertical modulation coil 202, respective pairs of horizontal modulation coils 203, 204 which are arranged to be in close contact with the vertical modulation coil 202 in the winding axis direction of the vertical modulation coil 202 and a pair of bias magnets 205, 206 which are arranged to be in close contact with respective outsides of respective pairs of horizontal modulation coils 203, 204 by coating an adhesive agent 208 to respective neighboring contact portions thereof, the close-contact state of these coils and magnets can be enhanced.

Figure 6:
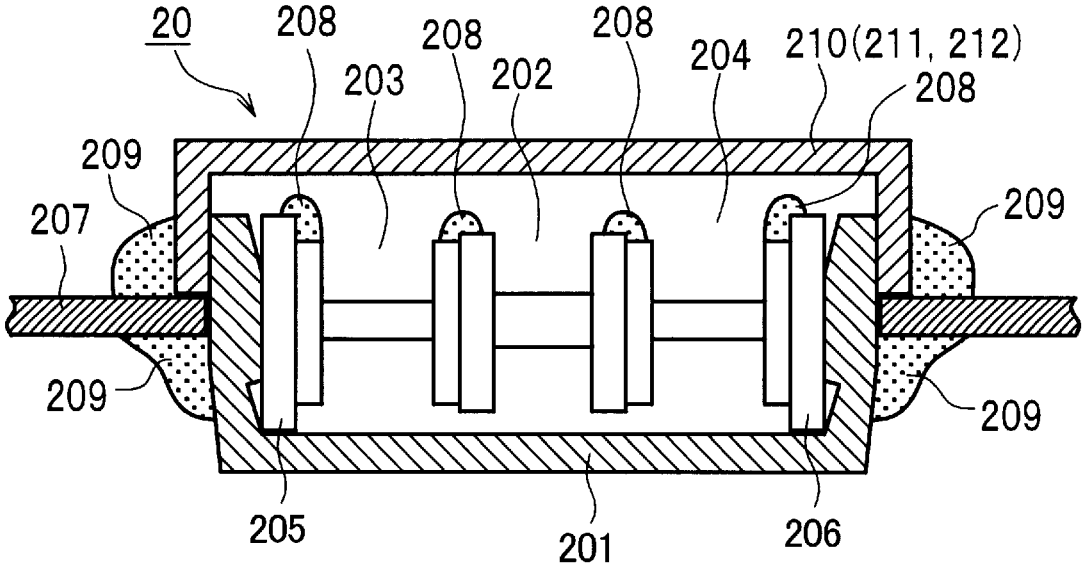
FIG. 6 is a schematic cross-sectional view for explaining the constitution of the fifth embodiment of the magnetic current modulator used in the color cathode ray tube according to the present invention.

FIG. 6 is a schematic cross-sectional view for explaining the constitution of the fifth embodiment of the magnetic current modulator used in the color cathode ray tube of the present invention. A planar shape of the magnetic current modulator is approximately as same as the planar shape of the magnetic current modulator shown in FIG. 12. Also in FIG. 6, coils which are wound around respective cores are omitted from the drawing. Numerals which are as same as those numerals used in FIG. 1 and FIG. 5 indicate parts which have identical functions.

In FIG. 6, outer walls of a resin casing 201 which constitutes the magnetic current modulator are provided with inclinations directed toward a bottom surface (lower side of FIG. 6). Then, the resin casing 201 is fitted into an opening formed in a printed circuit board 207 and a periphery of the resin casing 201 is fixedly secured using an adhesive agent 209.

Here, the fixing of the resin casing 201 using the adhesive agent 209 may be performed only with respect to one surface of the printed circuit board 207 or only with respect to the outer wall of the resin casing 201 at sides where bias magnets 205, 206 are positioned. In this case, the resin casing 201 and the printed circuit board 207 can be fixedly secured to each other using stopper means or other known fixing means such as caulking or screwing together with an adhesive agent.

Also in this embodiment, by fixedly securing a vertical modulation coil 202, a pair of horizontal modulation coils 203, 204 which are arranged to be in close contact with the vertical modulation coil 202 in the winding axis direction of the vertical modulation coil 202 and a pair of bias magnets 205, 206 which are arranged to be in close contact with respective outsides of a pair of horizontal modulation coils 203, 204 by coating an adhesive agent 208 to respective neighboring contact portions thereof, the close-contact state of these coils and magnets can be enhanced.

Figure 7:
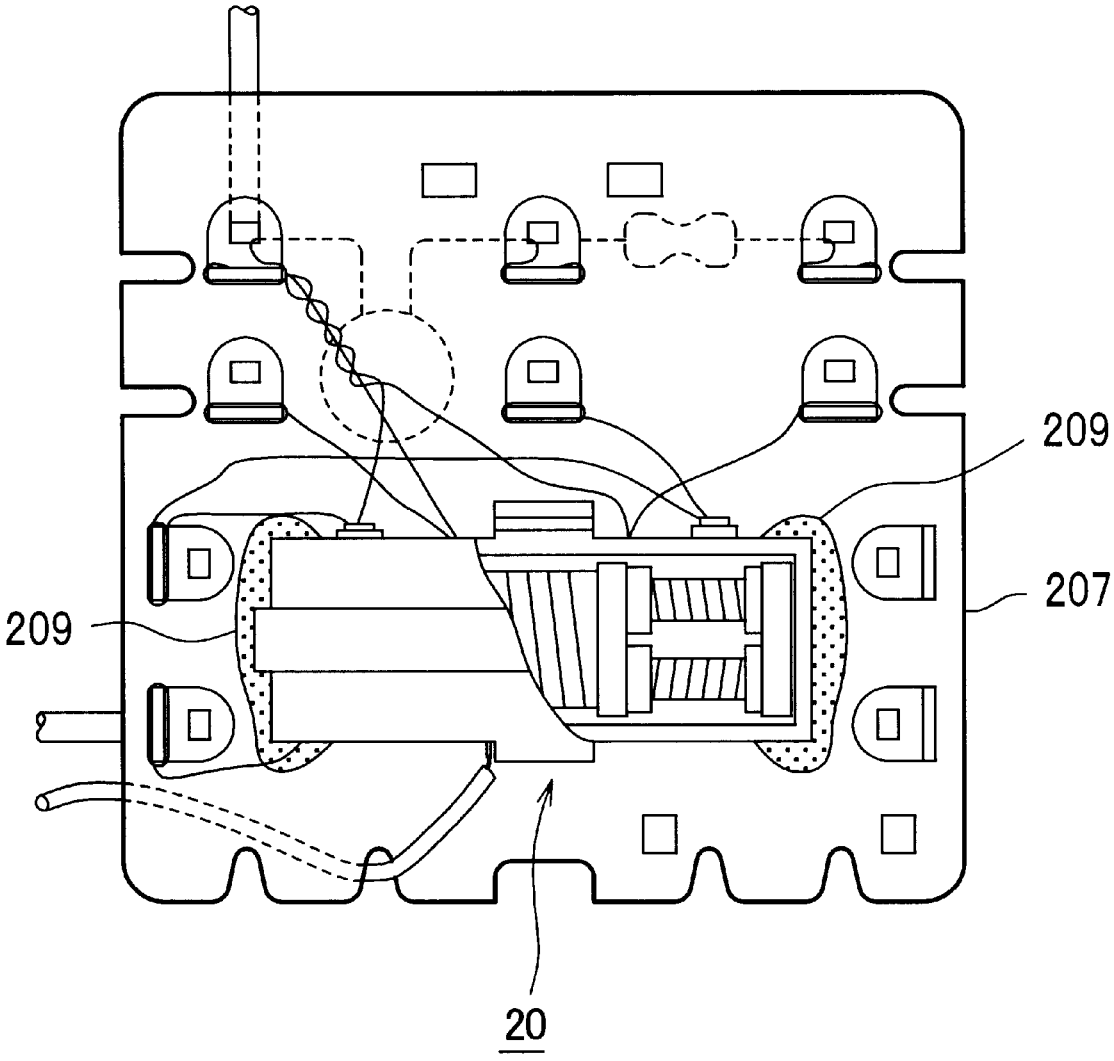
FIG. 7 is a plan view for explaining an example in which the magnetic current modulator used in the color cathode ray tube according to the present invention is mounted on a printed circuit board.

FIG. 7 is a plan view for explaining an example of mounting the magnetic current modulator used in the color cathode ray tube of the present invention on a printed circuit board. In the drawing, as the magnetic current modulator 20 employed in this embodiment, the magnetic current modulator which uses the clamp unit which has been explained in conjunction with FIG. 4 is illustrated as an example.

Figure 8:
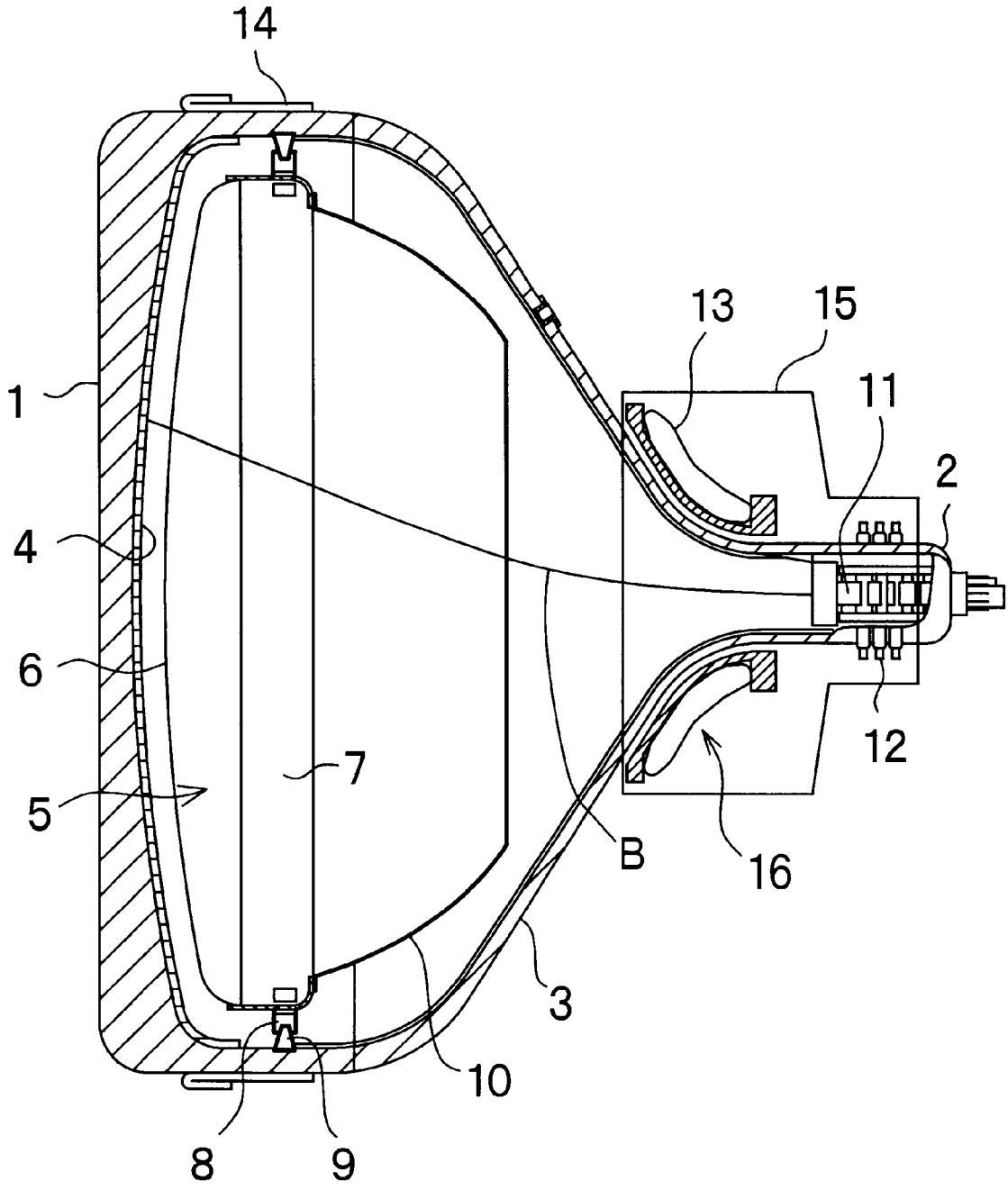
FIG. 8 is a side cross-sectional view for schematically explaining a structural example of a cathode ray tube in which a deflection unit is mounted on a color cathode ray tube.
Figure 9:
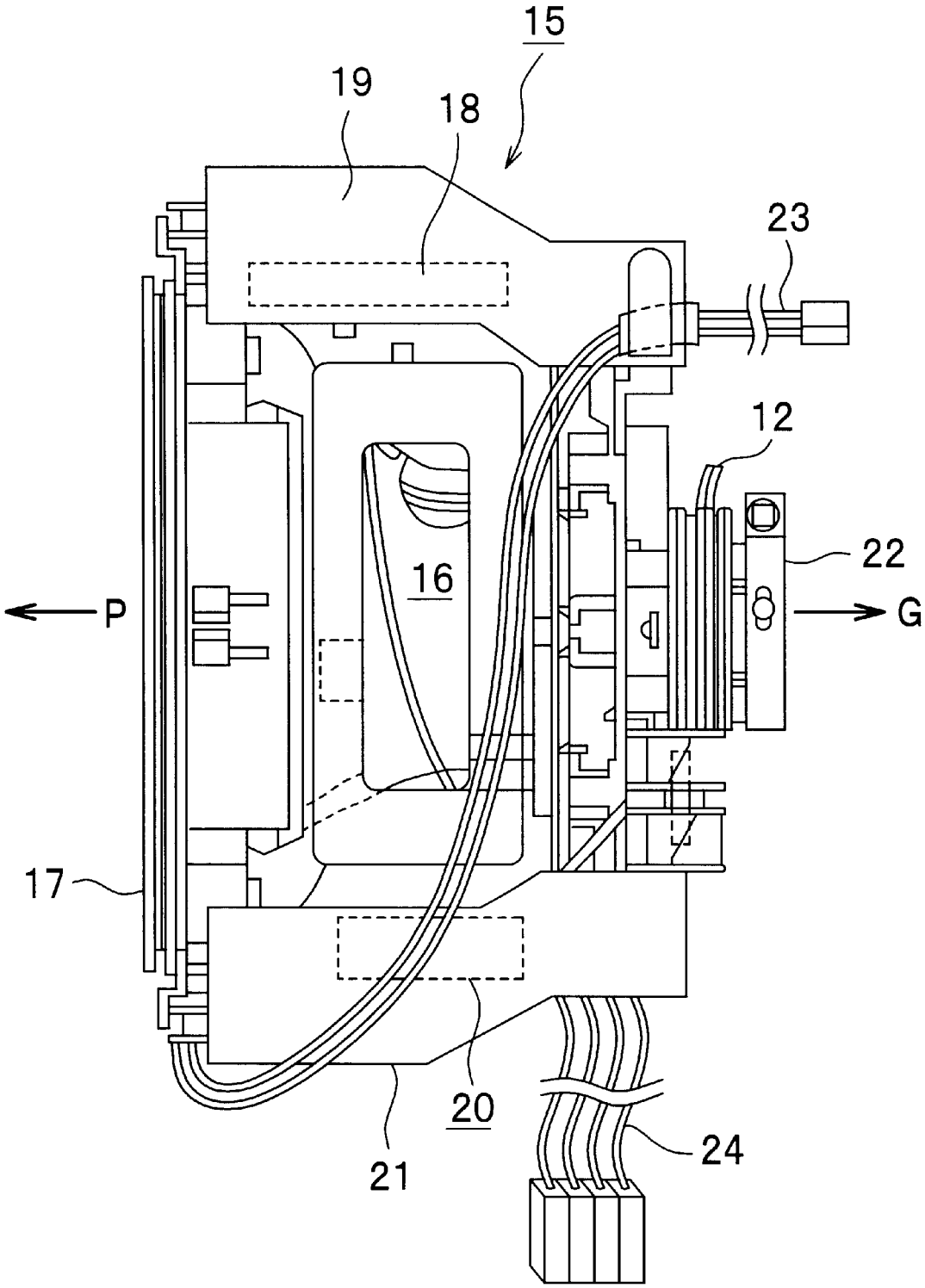
FIG. 9 is an enlarged side view of a deflection unit which is exteriorly mounted on a color cathode ray tube.
Figure 10:
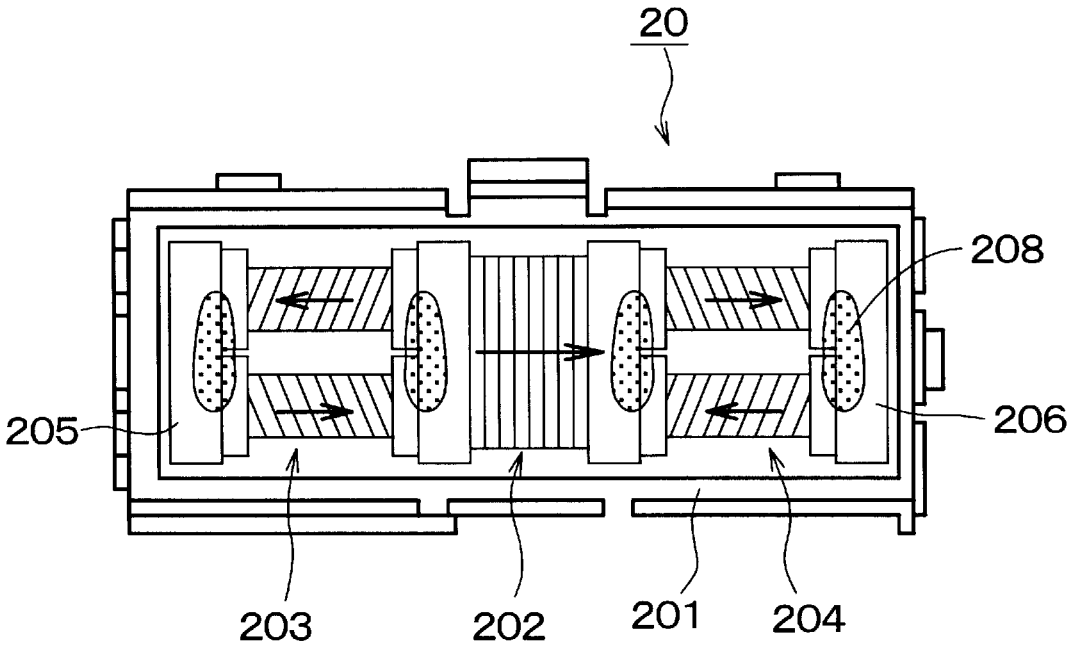
FIG. 10 is a plan view for explaining a constitutional example of a magnetic current modulator.
Figure 11:
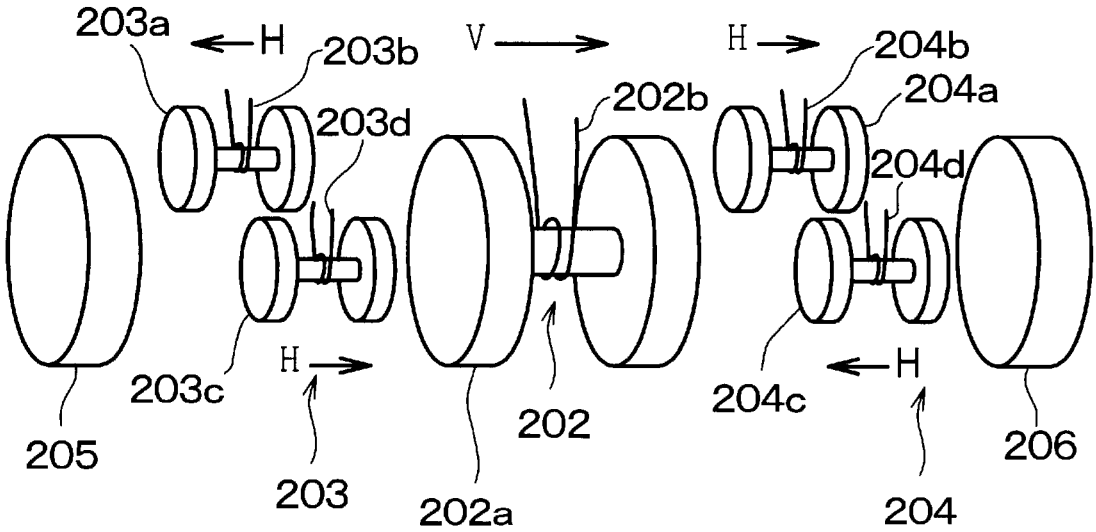
FIG. 11 is a developed view for explaining the arrangement of coils and bias magnets of the magnetic current modulator.

The fixing of the magnetic current modulator 20 to the printed circuit board 207 is performed by coating an adhesive agent to portions between a periphery of the resin casing 201 (short-side outer walls of the resin casing 201 in FIG. 7) and the printed circuit board 207. Also in this case, the resin casing 201 and the printed circuit board 207 can be fixedly secured to each other using stopper means or other known fixing means such as caulking or screwing together with the adhesive agent. As has been explained in conjunction with FIG. 8, the printed circuit board 207 is mounted in the deflection unit of the color cathode ray tube.

In this manner, according to the respective embodiments of the present invention, the generation of the uncomfortable sound caused by the magnetic current modulator in various kinds of cathode ray tubes including the color cathode ray tube can be prevented so that the cathode ray tube having high quality can be provided.

As has been explained heretofore, according to the present invention, it is possible to provide the cathode ray tube of high quality which can prevent the uncomfortable sound generated by the mechanical vibration derived from the magnetic distortion of the vertical or horizontal cores and the bias magnets which constitute the magnetic current modulator.

What is claimed is:

1. A color cathode ray tube in which a vacuum envelope is constituted of a panel portion having a phosphor screen, a neck portion which houses an electron gun irradiating electron beams, and a funnel portion which connects the panel portion and the neck portion contiguously, and a deflection unit which comprises a deflection yoke which deflects the electron beams in two directions consisting of horizontal and vertical directions and a magnetic current modulator which corrects a distortion of a screen is exteriorly mounted over the funnel portion and the neck portion, wherein the magnetic current modulator includes a vertical core around which a vertical modulation coil is wound, horizontal cores which are arranged at both ends of the vertical core in the winding axis direction and around which horizontal modulation coils are wound, a pair of bias magnets which are arranged in the winding axis direction at the outside of the respective horizontal cores such that a pair of bias magnets sandwich the respective horizontal cores and the vertical core, and a resin casing which houses the vertical core, the horizontal cores and the bias magnets, and the color cathode ray tube further includes a clamp unit which resiliently presses the respective horizontal cores and vertical cores from the outside of the resin casing and from both ends in the winding axis direction.

2. A color cathode ray tube according to claim 1, wherein the clamp unit is formed of nonmagnetic metal having resiliency.

3. A color cathode ray tube according to claim 1, wherein respective pairs of horizontal cores and a pair of the bias magnets are fixed to each other by means of an adhesive agent.

4. A color cathode ray tube according to claim 2, wherein respective pairs of horizontal cores and a pair of the bias magnets are fixed to each other by means of an adhesive agent.

5. A color cathode ray tube according to claim 1, wherein the resin casing of the magnetic current modulator is allowed to pass through an opening formed in the printed circuit board and, the resin casing and the printed circuit board are fixedly secured to each other by means of an adhesive agent.

6. A color cathode ray tube according to claim 2, wherein the resin casing of the magnetic current modulator is allowed to pass through an opening formed in the printed circuit board and the resin casing and the printed circuit board are also fixedly secured to each other by means of an adhesive agent.

7. A color cathode ray tube according to claim 3, wherein the resin casing of the magnetic current modulator is allowed to pass through an opening formed in the printed circuit board and the resin casing and the printed circuit board are also fixedly secured to each other by means of an adhesive agent.

8. A color cathode ray tube according to claim 4, wherein the resin casing of the magnetic current modulator is allowed to pass through an opening formed in the printed circuit board and-the resin casing and the printed circuit board are also fixedly secured to each other by means of an adhesive agent.

* * * * *